US007370593B1

(12) United States Patent
Horais

(10) Patent No.: US 7,370,593 B1
(45) Date of Patent: May 13, 2008

(54) WINDSURFING CATAMARAN VESSEL

(76) Inventor: Alan Horais, 7920 Rim Canyon Rd., Sunland, CA (US) 91040

( * ) Notice: Subject to any disclaimer, the term of this patent is extended or adjusted under 35 U.S.C. 154(b) by 0 days.

(21) Appl. No.: 11/647,991

(22) Filed: Dec. 27, 2006

(51) Int. Cl.

| | |
|---|---|
| ***B63H 9/00*** | (2006.01) |
| *B63B 1/00* | (2006.01) |
| *B63H 25/04* | (2006.01) |
| *B63H 25/00* | (2006.01) |
| *B63H 25/06* | (2006.01) |

(52) U.S. Cl. ..... 114/39.14; 114/39.12; 114/39.15; 114/61.1; 114/144 R; 114/153; 114/162; 114/163

(58) Field of Classification Search ..... 114/39.14, 114/61.1, 144 R, 162, 163, 39.12, 39.15, 114/153

See application file for complete search history.

(56) References Cited

U.S. PATENT DOCUMENTS 4,582,012 A * 4/1986 Montgomery ..... 114/61.25
6,199,499 B1 * 3/2001 Horais ..... 114/162

* cited by examiner

*Primary Examiner*—Lars A. Olson
*Assistant Examiner*—Daniel V Venne
(74) *Attorney, Agent, or Firm*—Robert M. Ashen, Esq.

(57) ABSTRACT

An improved windsurfing catamaran type vessel. The illustrated vessel has an improved steering mechanism that includes a relatively stiff but bendable plastic rod that is directly received within one or more guiding passageways or grooves formed in the plastic hull of the vessel. The plastic-to-plastic interface between rod and groove provides relatively low friction interengagement as the rod moves. The groove is open to ambient water, which will further reduce the friction. The rod has stiffness/flexibility characteristics that allow it to turn around relatively large radii while still being able to span relatively short distances without significant bending. A manual operative control member is pivotally mounted on the hull and connected to the rod in a manner which multiplies the force applied by the use; this provides the magnitude of force needed to move the rod with minimum exertion by the user. The presently preferred hull, which comprises a pair of side-by-side elongated hull sections is of the planing type by virtue of the generally flat lower surfaces of the hull sections. The illustrated hull is rotationally molded to provide internally hollow hull sections with a relatively thin outer wall or casing. The top and bottom walls of the hull sections are maintained spaced apart by a plurality of generally upright spacer sections which may be integrally formed during the molding operation. This type of hull skims or glides generally over the surface of the water as distinguished from displacement types which extend down below the surface. Generally flat bottom surfaces provide a maximized footprint for stability for the user while raising the sail and during windsurfing operation.

25 Claims, 6 Drawing Sheets

WINDSURFING CATAMARAN VESSEL

FIELD OF INVENTION

Windsurfing vessels having hulls of dual section catamaran configuration.

BACKGROUND OF THE INVENTION AND BRIEF DESCRIPTION OF THE ILLUSTRATED EMBODIMENT OF THE INVENTION

U.S. Pat. No. 6,199,499 owned by applicant discloses a windsurfing vessel having a hull of catamaran dual hull configuration. It is a useful and desirable vessel, having a number of features and advantages. The two hull sections are of the displacement type wherein the hulls extend down into the water. That vessel also has an effective steering mechanism that allows the user to manipulate or move a push/pull cable or rod that simultaneously operates rudders at the rear end of each of the hull sections. As shown in that patent, the cable is received within an elongated sleeve that supports and provides guidance for the cable. The sleeve is mounted on the hull of the vessel.

The illustrated windsurfing catamaran vessel disclosed in this application provides several significant improvements over the vessel disclosed in the afore mentioned patent.

Instead of using a displacement type hull, the illustrated hull is a planing type, having generally flat bottom surfaces that tend to plane, skim or ride over the surface of the water during operation of the vessel. This allows the present vessel, once it is obtained sufficient speed, to operate with less friction and at higher speeds. Further, the dual, generally flat, lower surfaces provide a wider broader base for the hull of the vessel, provides added stability while the user is raising the sail, and also during sailing or windsurfing of the vessel. There is greater stability as compared to any type single section hull, as well as compared to a two section displacement type hull.

The illustrated vessel also includes an improved steering mechanism. As noted above the steering mechanism illustrated in the patent includes a push/pull rod or cable which is received in and moved along an elongated casing that is mounted on the vessel hull. The present steering mechanism does not include a separate casing, but rather the rod is directly received in a groove or passageway formed in the plastic hull of the illustrated vessel. The plastic-to-plastic rod-to-groove interface provides a relatively low friction relationship. This allows the push/pull rod to move easily in either desired direction.

The groove is open to the water, which further reduces the friction between the rod and the groove; this is an advantage for this mechanism, as distinguished from the problem which the water could create by causing rust and corrosion in a mechanism that utilized metal parts such as a metal sleeve or casing.

The illustrated elongated plastic cable or rod is sufficiently rigid verse flexible so it can go around relatively large radii while still being able to span relatively short distances without significant bending.

The illustrated steering mechanism includes a pivoted control member that is connected to the rod in such a manner as to multiply the force applied by the user to achieve the desired magnitude of force to effectively move the rod.

IN THE DRAWINGS

DETAILED DESCRIPTION OF THE DRAWINGS

Figure 1:
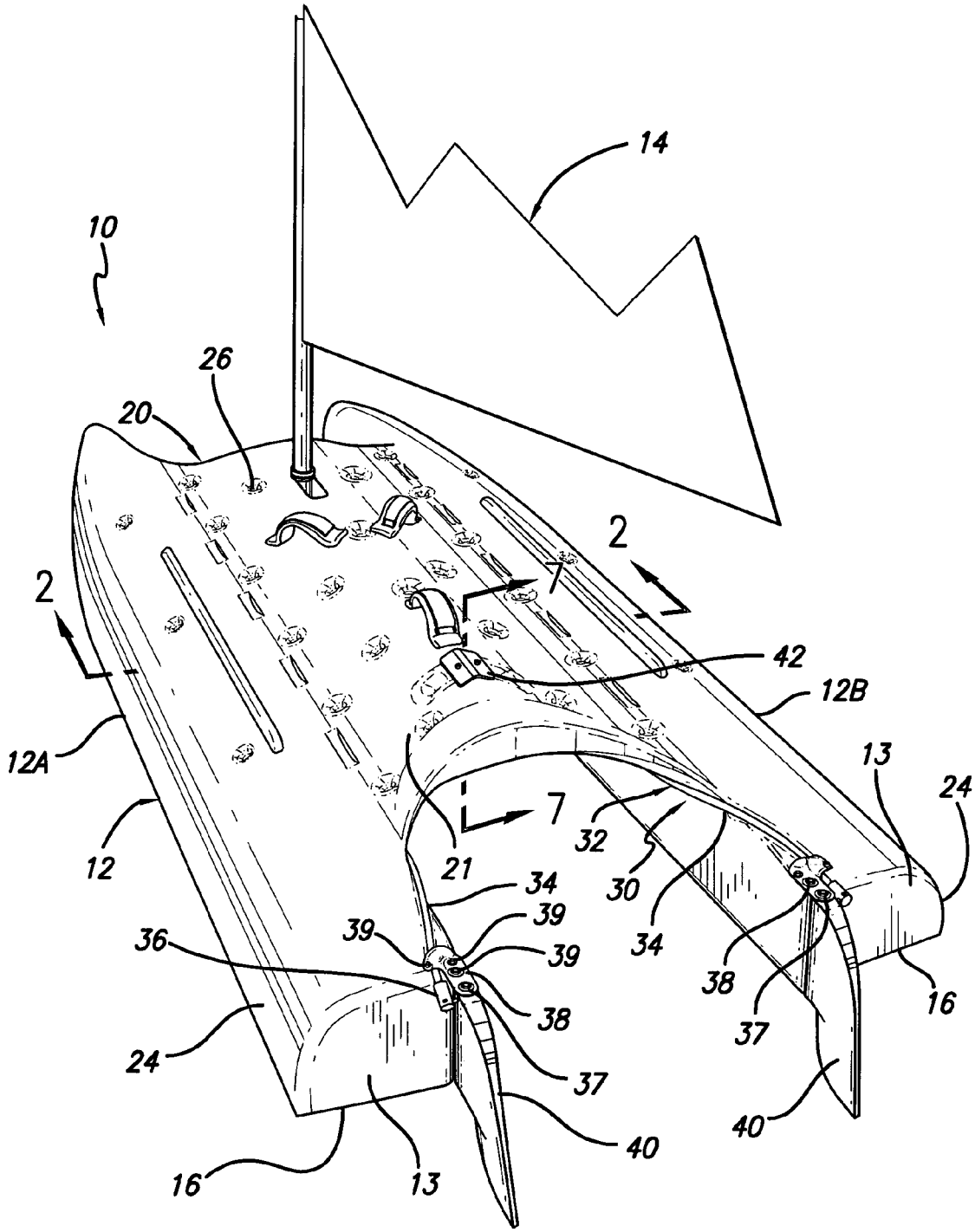
FIG. 1 is a perspective view of a windsurfing catamaran vessel which is a presently preferred embodiment of the invention.

The illustrated windsurfing catamaran vessel 10, which is a presently preferred embodiment of the invention, comprises a dual side section catamaran hull 12. A windsurfing sail assembly 14 universally mounted on the hull 12 may be moved by the user to an upright windsurfing position as shown in FIG. 1. The vessel 10 also includes improved steering mechanism 30.

The Hull

Figure 2:
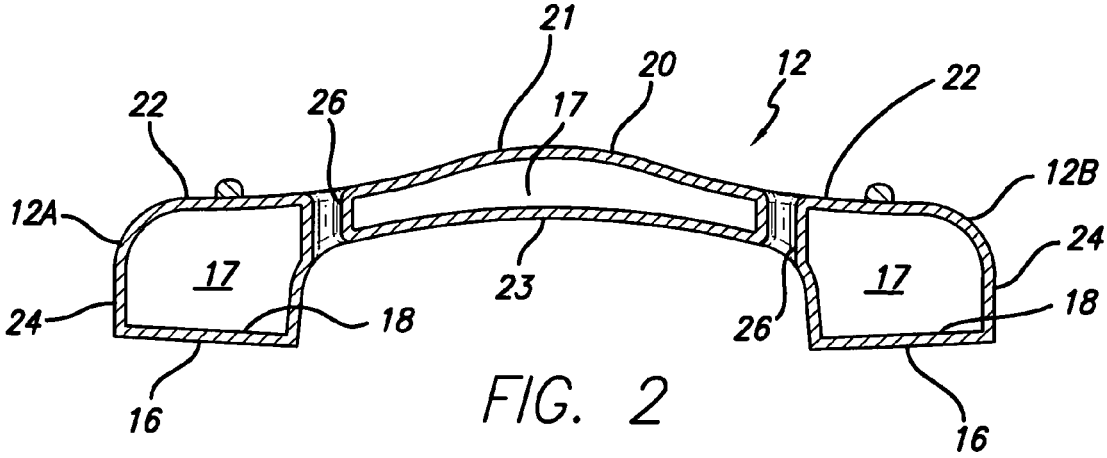
FIG. 2 is a schematic cross sectional view taken generally along line 2-2 of FIG. 1.

The illustrated catamaran hull 12 is comprised of a pair of elongated parallel side-by-side hull sections 12A, 12B. The two catamaran side sections 12A, 12B are connected by an intermediate or connecting center section 20. The upper surfaces of the sections 12A, 12B, and 20 provide a deck. The sail assembly 14 may be movably mounted on the deck. The side sections 12A, 12B have generally flat bottom surfaces 16 to facilitate planing or gliding over the surface of the water. The illustrated hull 12 is preferably produced by rotational molding, which provides an interior cavity 17 surrounded by a continuous and seamless outer wall, shell or casing. (See FIG. 2) In the water the vessel 10 tends to ride on the generally flat bottom surfaces 16 of the two catamaran hull side sections 12A, 12B. The bottom surfaces 16 are provided by bottom walls 18 of the catamaran hull side sections 12A, 12B. The catamaran hull side sections 12A, 12B also include top walls 22 and side walls 24. Each of the catamaran hull side sections 12A, 12B has a generally rectangular configuration. The center section 20 also has a top wall 21 and a bottom wall 23. The top walls 22 and 21 are supported and maintained spaced from the bottom walls 18 and 23 by a plurality of upright tubular spacer or connector portions 26 that are connected between the top and bottom walls. The upright portions 26 are preferably integrally formed when the catamaran hull is molded. The illustrated upright tubular spacer portions 26 have open centers that extend through the hull sections 12A, 12B and 20 from top to bottom as shown in FIG. 2. This open configuration saves material and reduces weight.

The illustrated hull 12 has been efficiently and effectively molded by a rotational molding process. The wall thickness is desirably between about 3/16 and 1/4 of an inch. To provide a desired wall thickness the material may be of a higher or lower density which will then dictate that the wall be somewhat thinner or thicker to achieve the desired structural integrity. The illustrated hull 12 has been successfully manufactured of polyethylene. As an example, high density cross linked polyethylene (HDXLP) has been found to produce a very good result. There are a variety of custom mixes available for such products. For example, Shulman, Inc. (Aschulman.com) sells a formulation designed for outdoor water craft called "Super Linear XLO370" (trademark). Other options are linear polyethylene (LPE) and cross linked polyethylene (HLPE).

In the rotational molding process in general, the material in powder form is placed within a closed mold and is heated so that it achieves a flowable form. The mold is then rotated so that the flowable material adheres to the wall of the mold. It is then allowed to cool, the mold is opened, and the final molded product is removed. This produces the integral lightweight, economical hull having an interior cavity or cavities defined by a relatively thin continuous outer wall or casing.

Other molding or production methods could be utilized such as standard hull building techniques using various materials such as fiberglass.

It will be noted in particular that the side walls 24 of the catamaran hull sections 12A, 12B are generally connected to the bottom walls 18 at approximately a 90 degree angle. This allows for a maximum bottom footprint for the hull 12. As noted above, this also provides for maximum stability, particularly while the user is attempting to raise the windsurfing sail. It also adds stability during the actual windsurfing operation.

The Steering Mechanism

Figure 4:
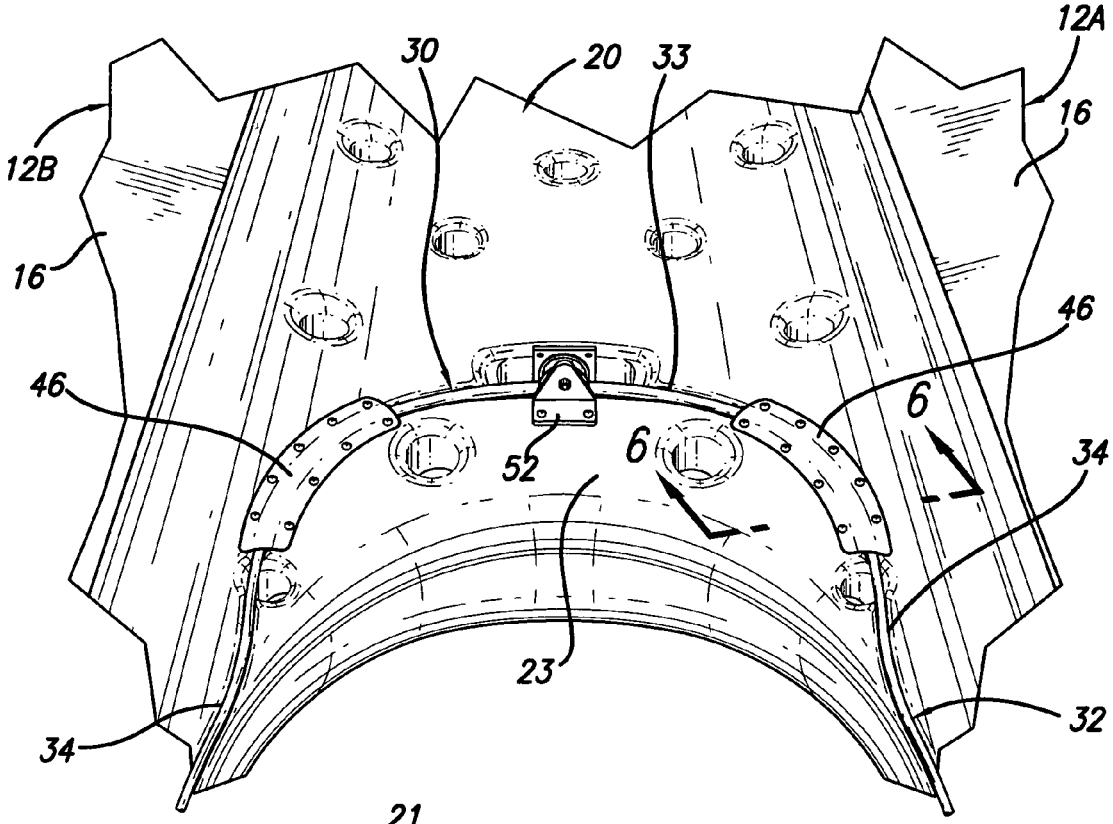
FIG. 4 is a view like FIG. 3, with the push-pull rod installed.
Figure 5:
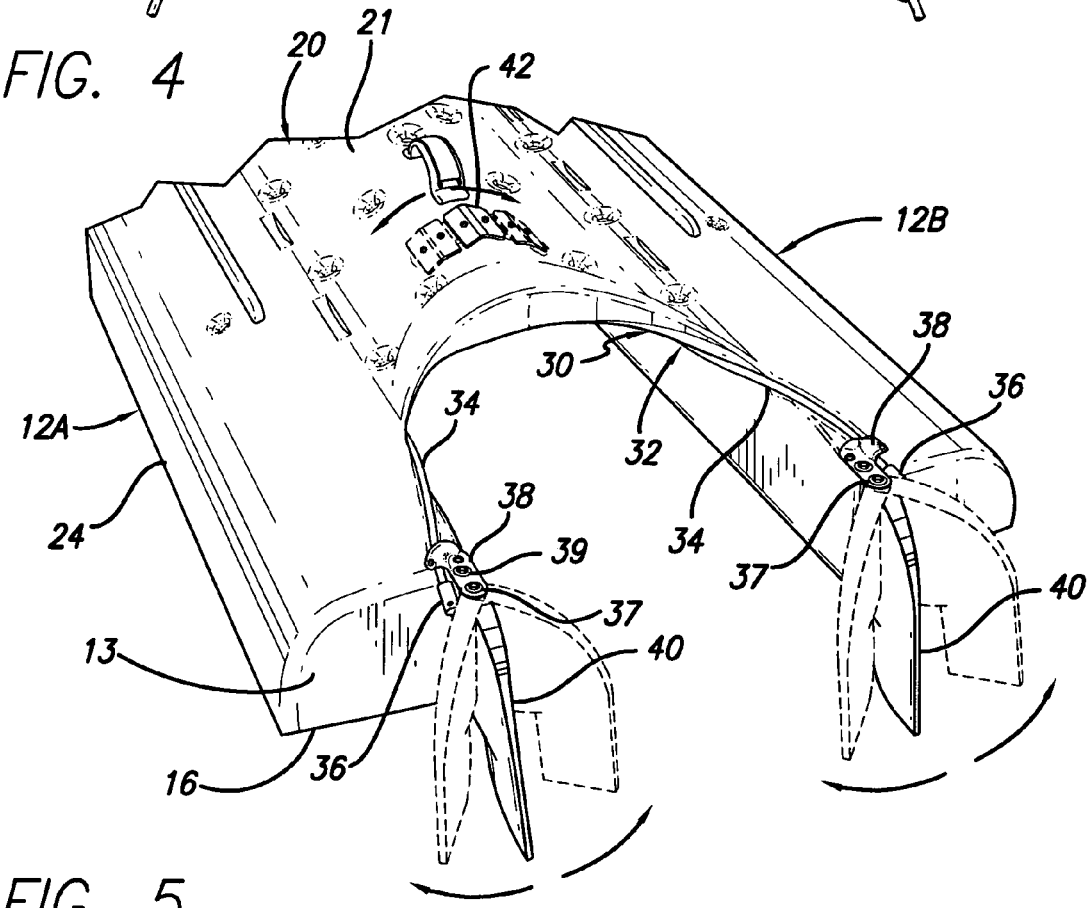
FIG. 5 is a partial top perspective view of the rear end of the vessel of FIG. 1, showing the rudders and the steering control member.

The improved steering mechanism 30 is seen best in FIGS. 4 and 5. As noted above, it broadly comprises an elongated push-pull rod 32 having a stiffness to flexibility relationship that allows it go around large radii while still being able to span short distances without significant bending. A current test model uses 3/8" (0.375") polyethylene or polypropylene rod with the tightest turning radius being about 5½" and the longest unsupported span being about 7".

When mounted in its retaining and guiding groove 44, the illustrated push/pull cable 32 extends in a generally U-shape. It comprises a center generally transversely extending portion 33 and a pair of leg portions 34 extending rearwardly to the rear ends 13 of the catamaran sections 12A, 12B. The end 36 of each rod leg portion 34 is pivotally connected, through an appropriate pivotally mounted interconnection link 38, to a rudder 40 that is pivotally supported at the rear end 13 of a hull section 12A, 12B. The rudders 40 are each rotatable around a generally upright pivot axle 37 to achieve steering of the vessel 10. The movement of the rod 32 in one direction or the other causes the rudders 40 to simultaneously pivot in the desired direction to thereby steer the vessel. The pivoted positions of the rudders 40 are illustrated in broken line in FIG. 5.

The movement of the rod 32 may be achieved by various means including the illustrated control member 42 which is movably mounted centrally on the hull center section 20 and connected to the rod 32. (See FIGS. 5 and 7.) The control member 42 includes a main, manually transversely movable, upper portion 43 and a lower or depending connecting portion 45. Portion 45 extends downwardly through a transversely extending opening 47 in the top wall 21 of the hull center section 20. The lower portion 45 is connected to the rod 32 in a manner which multiplies the force applied by the used to achieve the magnitude of force desired to move the rod. The control member 42 is manually moveable side-to-side, to thereby move the rod 32 in a desired direction; this in turn pivots the rudders 40 in the opposite direction to steer the vessel. The positions of the control member 42 to either side is shown in broken line in FIG. 5. The illustrated control member 42 may be moved either way as by the foot or hand of the user.

Figure 7:
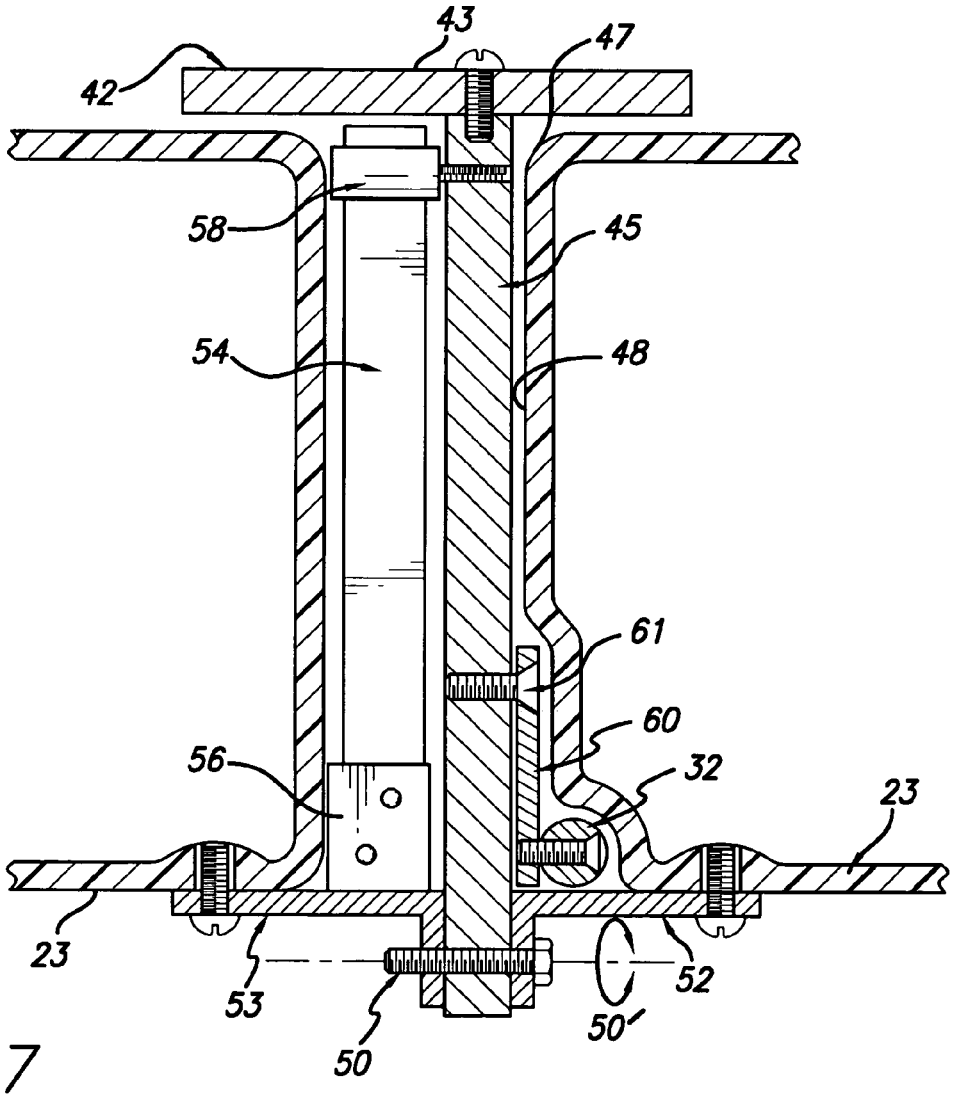
FIG. 7 is an enlarged sectional view taken generally along Line 7-7 of FIG. 1, showing the steering control member and its connection to the push-pull rod.
Figure 8:
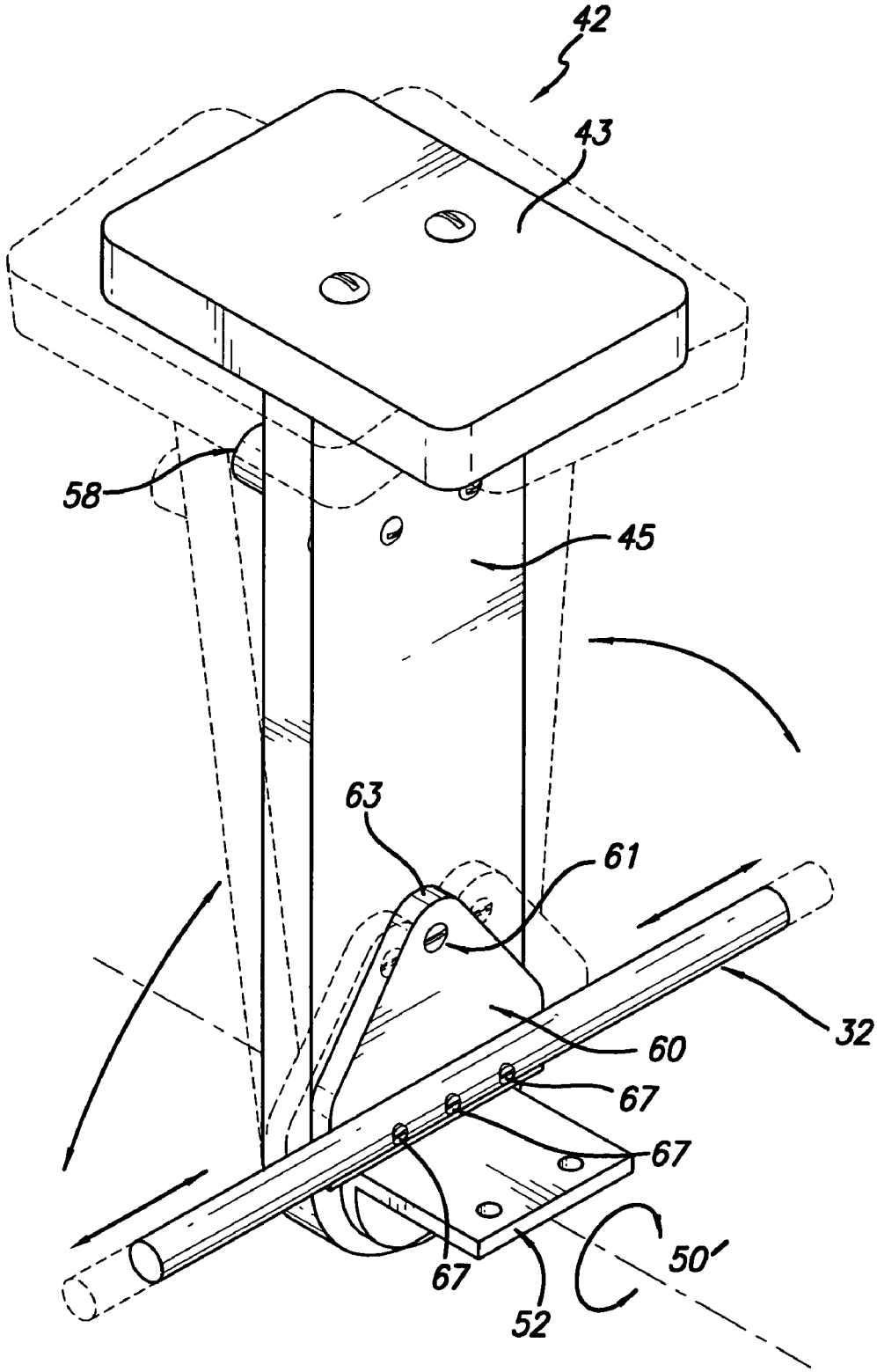
FIG. 8 is an enlarged schematic perspective view from the rear showing the control member, the connecting plate, the rod and the pivot pin of the steering control mechanism.
Figure 9:
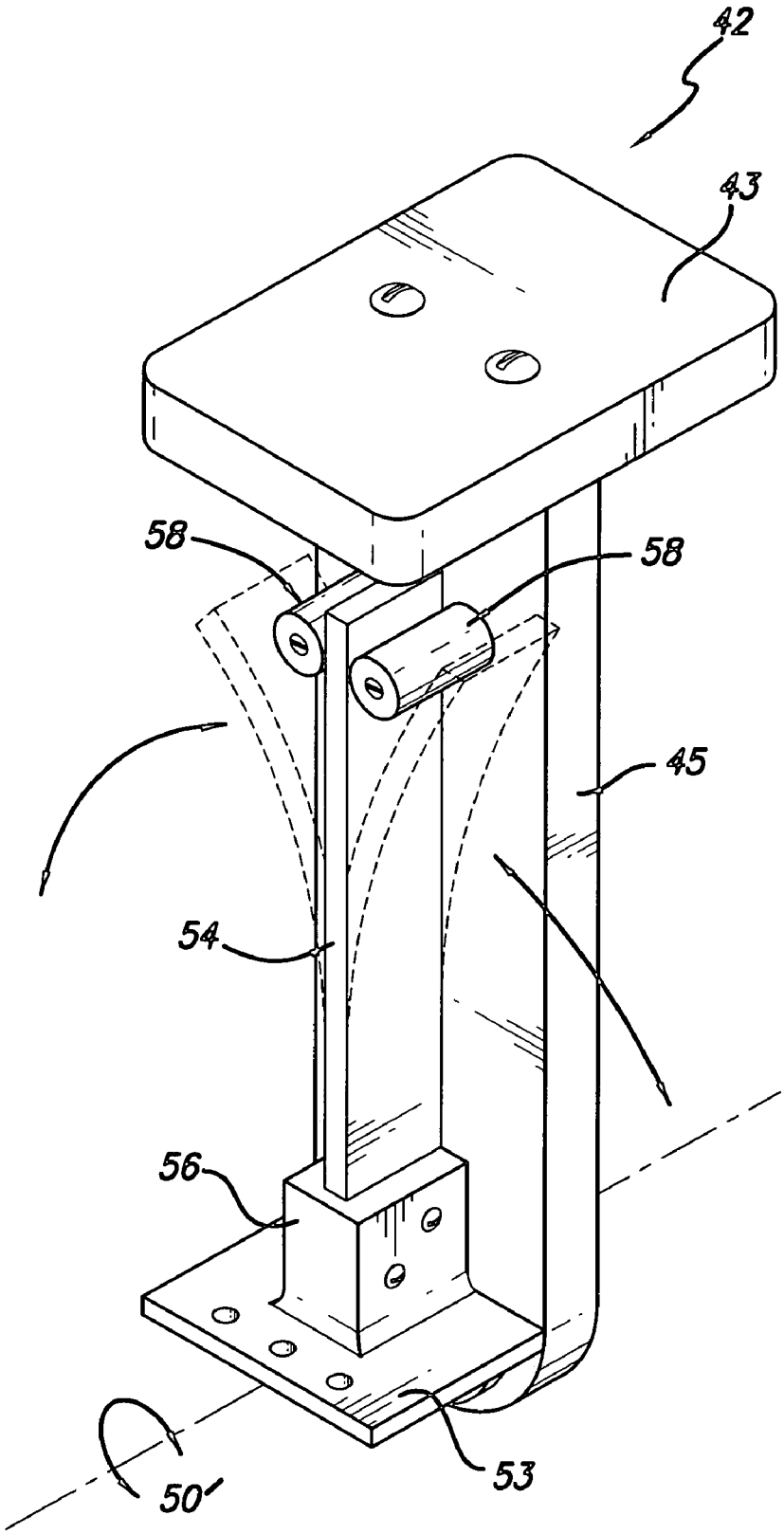
FIG. 9 is an enlarged schematic perspective from the front showing in particular the leaf spring and the rollers which provide the neutral position for the steering control mechanism.

FIGS. 7, 8 and 9 illustrate in detail the steering control portion of the illustrated steering mechanism 30. The upper portion 43 of the control member 42 is attached as by screws to the connecting or depending portion 45. Depending portion 45 extends through the opening 47 and down through an open compartment 48 that extends from opening 47 down through to the underside of the hull. The depending portion 45 is pivotally mounted at its lower end on a pivot pin 50 (provided by a bolt and nut) that extends generally horizontally front-to-back just below the lower end of the compartment 48. The pivot pin 50 is supported by a rear mounting bracket 52 and a front mounting bracket 53 which are secured to the hull as with screws. This arrangement allows the manually moveable upper portion 43 to pivot transversely about the pivot axis 50' defined by the pivot pin 50.

The control member 42 is generally maintained at a center neutral position by an elongated generally upright leaf spring 54 that is mounted at its lower end on an upwardly extending mounting tab portion 56 of the front mounting plate 53. The spring 54 extends upwardly through the compartment 48, and its upper end is received between a pair of rollers 58 mounted adjacent the upper end of the depending portion 45, as seen best in FIGS. 7 and 9. This arrangement allows the control member 42 to be moved transversely to either side-to-side by the user, and to automatically return to a neutral central position when no user force is being applied to the control member.

FIGS. 7 and 8 illustrate how the control member 42 is connected to the rod 32 so that the rod moves or shifts to one side or the other when the control member upper portion 43 is moved side-to-side in either direction. There is a triangularly shaped connecting plate 60 that is pivotally connected at an upward positioned apex 63 as by means of a screw 61 to the a lower portion of the depending portion 45. The plate 60 is fixedly connected along its lowermost edge 65 as by means such as several screws 67 to the adjacent portion of the control rod 32. By virtue of this arrangement, when the control member 42 pivots around the pivot pin 50, the connecting plate 60 pivots about the screw 61, and the connecting plate and the adjacent portion of the rod 32 are moved generally linearly in one sideward direction or the other (See broken lines in FIG. 8). The connecting plate 60 and the adjacent portion of the rod 32 move downwardly a relatively short distance; this is permitted by the flexibility of the rod 32 and sufficient space between the rod 32 and the rear mounting plate 52.

As noted above, the force applied by the user is multiplied so as to provide desired force to shift the rod 32. In particular, the rod 32 connected to a point on the depending portion 45 close to the pivot axis 50' of the pivot pin 50, while the manually moveable upper portion 43 control member is at the upper end of the depending portion 45, a substantial distance from the pivot axis. This arrangement provides a mechanical advantage which allows the user to move the rod with the application of minimum force. In a working model of the vessel, a multiplier of at least 2:1 (force on portion 45 vs. force on rod 32) has proved useful and effective.

Figure 3:
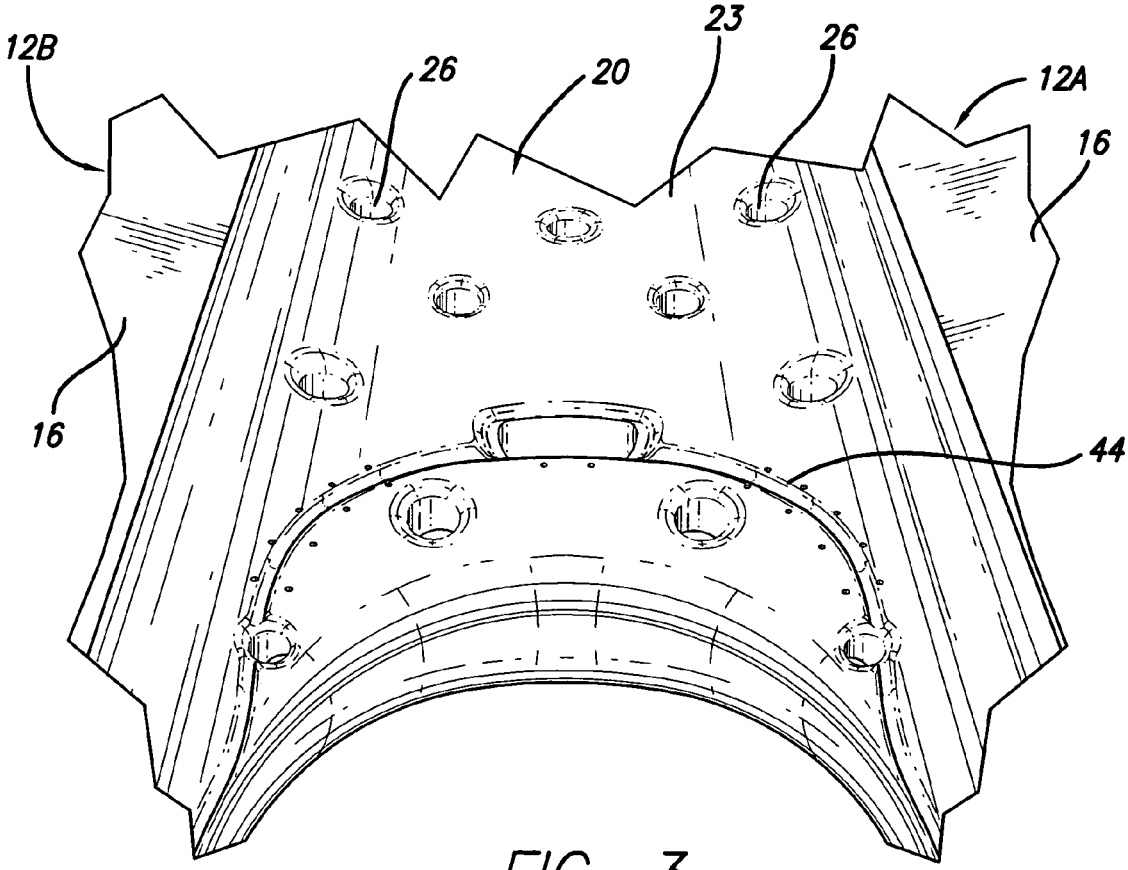
FIG. 3 is a partial perspective bottom view of the vessel of FIG. 1, without the push-pull rod installed.
Figure 6:
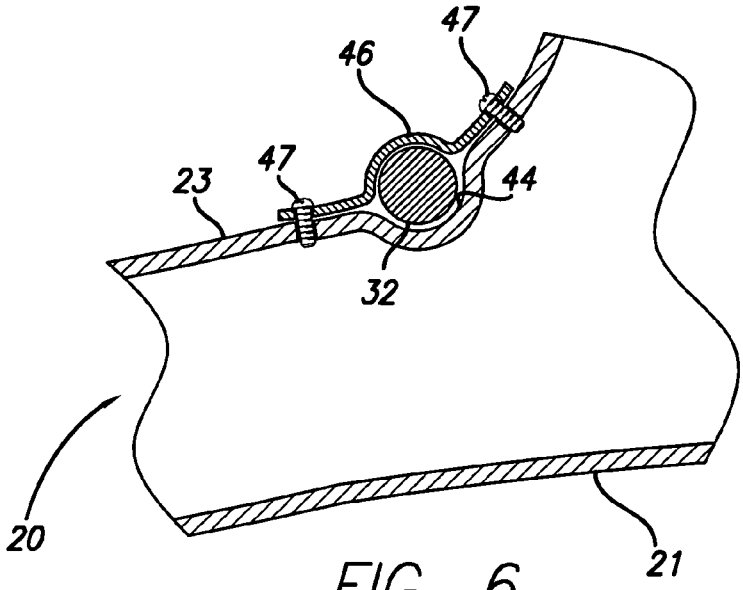
FIG. 6 is an enlarged sectional view taken generally along Line 6-6 of FIG. 4, showing the push-pull rod in its groove.

The rod 32 extends through and along the mating groove 44 formed in the hull 12 to provide a pathway defining the path of the rod in its generally U-shaped configuration. The groove 44 is shown best in FIGS. 3 and 6. The rod 32 and the cross section of the groove 44 are generally selected to allow the rod to readily and easily move in either direction within the groove. The materials of the hull 12 and the rod 32 are such, as noted above, to provide relatively low friction between them. This is satisfactorily achieved when the hull and the rod are both made of polyethylene material.

In the illustrated vessel 10, a pair of side retainer plates 46 and a pair of rear retainer plates 38 are provided to maintain the rod 32 in the guiding groove 44. The retainer plates 46 may be made of a low friction material such as the polyethylene or polypropylene. The plates 46 may be secured in place by any suitable means such as screws 47. The retainer plates 38 are secured to the hull 12 as by screws 39. The rearward end of each retainer plate supports the upper end of the pivot axle 37 for an associated rudder 40. The plates 38 may be made of a stronger but low friction material such as fibre glass.

The illustrated rod has a diameter of approximately ⅜ an inch, which has provided reliable and desirable results. The illustrated mating groove has a slightly larger diameter of about 7⁄16 of an inch. The exact sizes could be modified somewhat depending on the requirements of the particular vessel and the desired functioning of the mechanism.

Other materials were tested and considered but did not produce as desirable results as the high density polyethylene rod described above. Polycarbonate was too stiff to bend around the large radii. Peek (poletheretherkeytone) was also too stiff to bend around the large radii. Low-density polyethylene was insufficiently stiff to bridge short distances without bending. Polypropylene was generally satisfactory, but is somewhat less desirable for various reasons including being more costly.

Various modifications and changes may be made in the specifics of the illustrated structure without departing from the spirit and scope of the present invention as set forth in the following claims.

The invention claimed is:

1. Windsurfing vessel having a catamaran-type hull comprising dual hull sections, the vessel having a rudder movably mounted at the rear of each hull section, a push/pull rod with opposed ends, each end being connected to one of the rudders to generally simultaneously move the rudders to steer the vessel, the rod being an elongated flexible element having a relatively low-friction surface, the hull having at least one recessed pathway that extends into the hull, the pathway having a relatively low-friction surface, the rod being directly received and retained in the pathway so that the surfaces of the rod and the pathway directly engage each other as the rod moves in the pathway, the rod being movable in either direction longitudinally of the rod, and a control member connected to the rod for moving it longitudinally to effect movement of the rudders to steer the vessel.

2. The vessel of claim 1 wherein the surfaces of the rod and the groove are of a plastic material.

3. The vessel of claim 2 wherein at least one of said surfaces is polyethylene.

4. The vessel of claim 3 wherein both of said surfaces is polyethylene.

5. The vessel of claim 3 wherein said surfaces are of high-density polyethylene.

6. The vessel of claim 2 wherein said rod is a single integrated piece of material.

7. The vessel of claim 2 wherein said groove is formed in the hull which is made of a relatively low-friction plastic material.

8. The vessel of claim 7 wherein the hull is made of polyethylene.

9. The vessel of claim 7 wherein said pathway is molded in the hull.

10. The vessel of claim 9 wherein said hull is molded by a rotational method.

11. The vessel of claim 1 further comprising cover members securable over at least portions of the pathway to retain the rod in the groove.

12. The vessel of claim 11 wherein the cover members have relatively low-friction surfaces facing the rod.

13. The vessel of claim 1 wherein the hull sections have generally flat bottom surfaces for planing on the water's surface.

14. The vessel of claim 1 wherein the pathway is generally open to the ambient water to allow the water to enter the groove and thereby reduce friction between the rod and the groove.

15. The vessel of claim 1 wherein said rod has a stiffness to flexibility character which allows it to extend around relatively large radii while also being able to span relatively short distances without significant bending.

16. A catamaran type vessel particularly adapted for windsurfing, said vessel having a unitary hull comprising a pair of generally parallel side sections and a center connecting deck section, said sections being integrally formed with one another, said side sections being hollow and having spaced apart top and bottom walls, said bottom walls of said side sections each having a bottom surface that is generally flat, the top and bottom walls of said side sections being generally thin, said hull including spacer connector portions that extend between said top and bottom walls to maintain the structural integrity of the side sections, at least one of said spacer connector portions having an open center that extends through said top and bottom walls, said sections providing a deck, and a wind sail assembly universally mounted on said deck for movement to a generally upright wind surfing position.

17. The vessel of claim 16 wherein said spacer portions have a generally open center that extends through said top and bottom walls.

18. The vessel of claim 16 wherein said hull is formed by a rotational molding method.

19. The vessel of claim 16 wherein each of the hull side sections has an outward side wall that meets the bottom wall of that side section at a generally right angle.

20. A unitary hull for a catamaran type vessel, the hull being particularly adapted for windsurfing, said hull comprising a pair of generally parallel side sections and a center connecting section, said sections being integrally formed with one another, said side sections being hollow and having spaced apart top and bottom walls, said side section bottom walls each having a bottom surface that is generally flat, and a plurality of integrally formed, generally upright, spacer connector portions that extend between the top and bottom walls of said side sections, at least one of said spacer connector portions having an open center that extends through said top and bottom walls.

21. The hull of claim 20 wherein said upright spacer connector portions are generally tubular and have an open center that extends through said top and bottom walls.

22. The hull of claim 20 wherein each of said side sections has an outward side wall that meets the generally flat bottom wall of that side section at a generally right angle.

23. A method for molding a unitary hull for a catamaran type vessel particularly adapted for windsurfing, the hull comprising a pair of generally parallel side sections and a center connecting section, said side and center sections being hollow, having spaced apart top and bottom walls, being integrally formed with one another, and having a plurality of integrally formed, generally upright, spacer connector portions extending between said top and bottom walls, at least one of said spacer connector portions having an open center that extends through said top and bottom walls, each of said side sections having a bottom surface that is generally flat, said method comprising molding the hull by a rotational method.

24. The method of claim 23 further comprising molding, by a rotational method, a pathway directly into the hull to receive an elongated push-pull steering control rod.

25. Manually operable steering control mechanism for a windsurfing catamaran vessel that has a deck and a pair of rudders, the control mechanism including a push/pull rod that is connected to the rudders so as to effect pivoting of the rudders to steer the vessel when the rod is shifted in either direction, the control mechanism also including a control member having a manually moveable control portion positioned on the deck of the vessel and an elongated depending portion connected to the manually moveable control portion, the depending portion being mounted at a lower end for pivotal movement about a pivot axis, the depending portion being connected to the push/pull rod so as to shift the rod generally linearly in either direction when the control member is pivoted by the control portion in either direction to a turning position, the distance between the pivot axis and the control portion being substantially greater than the distance between the pivot axis and the point where the depending portion is connected to the rod, so as to provide mechanical leverage whereby a minimum force is required by the user to achieve desired force required to achieve said generally linear movement of the control rod, said control mechanism further comprising a connecting member pivotally connected to the depending portion and fixably connected to the rod, said control mechanism still further comprising spring biasing means to urge the control member to a neutral position when the control member is not being maintained in a turning position by the user, the spring biasing means comprising a generally upright leaf spring mounted on the hull and a pair of rollers mounted in parallel adjacent positions on the control member, the spring having a free end that extends between the rollers.

* * * * *